US005381763A

United States Patent [19]

Niemchick

[11] Patent Number: 5,381,763

[45] Date of Patent: Jan. 17, 1995

[54] DRY HEAD COOLING SYSTEM

[75] Inventor: Robert L. Niemchick, Lake Villa, Ill.

[73] Assignee: Outboard Marine Corporation, Waukegan, Ill.

[21] Appl. No.: 127,792

[22] Filed: Sep. 28, 1993

[51] Int. Cl.[6] ..... F01L 1/12

[52] U.S. Cl. ..... 123/41.82 R; 123/41.09

[58] Field of Search ..... 123/41.08, 41.09, 41.82 R, 123/193.5, 41.29

[56] References Cited

U.S. PATENT DOCUMENTS

| | | | |
|---|---|---|---|
| 1,253,695 | 1/1918 | La Porte . | |
| 2,656,825 | 10/1953 | Hartz | 123/41.13 |
| 2,808,038 | 10/1957 | Scherenberg | 123/41.1 |
| 3,667,431 | 6/1972 | Kueny et al. | 123/41.08 |
| 3,805,748 | 4/1974 | Garcea et al. | 123/41.1 |
| 3,908,579 | 9/1975 | Miller et al. | 115/17 |
| 4,133,284 | 1/1979 | Holcroft | 115/75 |
| 4,140,089 | 2/1979 | Kueny et al. | 123/41.08 |
| 4,589,378 | 5/1986 | Hundertmark | 123/41.02 |
| 4,759,181 | 7/1988 | Biritz | 60/321 |
| 5,048,467 | 9/1991 | Kojima | 123/41.74 |
| 5,048,468 | 9/1991 | Broughton et al. | 123/41.74 |
| 5,109,809 | 5/1992 | Fujimoto | 123/41.31 |

FOREIGN PATENT DOCUMENTS 49063 of 1988 Japan .

*Primary Examiner*—Noah P. Kamen

*Attorney, Agent, or Firm*—Michael, Best & Friedrich

[57] ABSTRACT

Disclosed herein is a cylinder head assembly comprising a cylinder head including a planar surface adapted for engagement with a cylinder block and having therein a combustion chamber recess, a coolant jacket located adjacent to the combustion chamber, and a coolant passage extending in the cylinder head remotely to the recess, a pressure responsive valve communicating with said coolant jacket and with a source of coolant and operative to supply coolant to the coolant jacket when the coolant is above a predetermined pressure, and a temperature response valve communicating with the coolant passage and with a supply of coolant and operative to supply coolant to the coolant passage when the coolant is above a predetermined temperature.

15 Claims, 3 Drawing Sheets

DRY HEAD COOLING SYSTEM

BACKGROUND OF THE INVENTION

The invention relates generally to marine propulsion devices such as outboard motors and stern drive units.

The invention also relates generally to internal combustion engines (such as are used in outboard motors and stern drive units) and to arrangements for cooling the cylinder head or (*) of such internal combustion engines. Still more particularly, the invention relates to 2-stroke and 4-stroke internal combustion engines. Attention is directed to the following U.S. Pat. Nos.:

| | | |
|---|---|---|
| 1,253,695 | N. M. La Porte | January 15, 1918 |
| 2,656,825 | M. E. Hartz | December 6, 1950 |
| 2,808,038 | H. O. Scherenberg | March 23, 1954 |
| 3,667,431 | Don F. Kueny | January 5, 1970 |
| 3,805,748 | Giampaolo Garcea | February 4, 1972 |
| 3,908,579 | George E. Miller | September 30, 1975 |
| 4,133,284 | William Holcroft | January 9, 1979 |
| 4,140,089 | Don F. Kueny | February 20, 1979 |
| 4,589,378 | James Hundertmark | May 20, 1986 |
| 4,759,181 | Ronald A. Biritz | July 26, 1988 |
| 5,048,467 | Akinori Kojima | September 17, 1991 |
| 5,048,068 | George Broughton | September 17, 1991 |
| 5,109,809 | Hiroski Fujimoto | February 28, 1991 |

Attention is also directed to Japanese Patent Publication 49,063/88.

SUMMARY OF THE INVENTION

The invention provides a cylinder head assembly comprising a cylinder head including a planar surface adapted for engagement with a cylinder block and having therein a combustion chamber recess, a coolant jacket located adjacent to the recess, and a coolant passage extending in the cylinder head remotely from the recess, pressure responsive valve means communicating with the coolant jacket and with a source of coolant and operative to supply coolant to the coolant jacket when the coolant is above a predetermined pressure, and temperature response valve means communicating with the coolant passage and with a supply of coolant and operative to supply coolant to the coolant passage when the coolant is above a predetermined temperature.

The invention also provides a cylinder head assembly comprising a cylinder head including a planar surface adapted for engagement with a cylinder block and having therein a combustion chamber recess, a coolant jacket recess located in the planar surface, adjacent to the combustion chamber recess, and including an inlet having a cross sectional area, and an outlet having a cross sectional area less than the cross sectional area of the inlet, whereby to maintain the coolant jacket recess full of coolant upon supply of coolant to the inlet, and a coolant passage recess located in the planar surface and extending in spaced relation to the combustion chamber recess and with the coolant jacket recess located between the coolant passage recess and the combination chamber recess, a pressure responsive valve communicating with the inlet of the coolant jacket recess and with a source of coolant and operative to supply coolant to the coolant jacket recess when the coolant is above a predetermined pressure, and a temperature responsive valve communicating with the coolant passage recess and with a source of coolant and operative to supply coolant to the coolant passage recess when the coolant is above a predetermined temperature.

The invention also provides an internal combustion engine comprising a cylinder block including a planar closed deck surface, at least one cylinder opening into the closed deck surface, and an engine cooling jacket including a first portion extending adjacent to the cylinder and having a closed end in spaced relation to the closed deck surface, and a second portion remote from the first portion, a cylinder head including a planar surface in engagement with the closed deck surface of the cylinder block and having therein at least one combustion chamber recess located in the cylinder head planar surface and communicating with the cylinder, a coolant jacket recess located in the cylinder head planar surface and adjacent to the combustion chamber recess, and a coolant passage recess located in the cylinder head planar surface and extending in spaced relation to the combustion chamber recess and with the coolant jacket recess being located between the coolant passage recess and the combustion chamber recess, a pressure responsive valve communicating with the second portion of the engine coolant jacket and with the coolant jacket recess and operative to supply coolant to the coolant jacket recess from the second portion of the engine cooling jacket when the coolant in the second portion of the engine coolant jacket is above a predetermined pressure, and a temperature responsive valve communicating with the first portion of the engine cooling jacket and with the coolant passage recess and operative to supply coolant to the coolant passage recess when the coolant in the first portion of the engine coolant jacket is above a predetermined temperature.

The invention also provides a cylinder head assembly comprising a cylinder head including a surface adapted for engagement with a cylinder block and having therein a combustion chamber recess, and a coolant jacket located in the head adjacent the recess, and means for preventing coolant flow to the coolant jacket when engine speed is below a predetermined speed, even if engine temperature is hot.

The invention also provides an internal combustion engine including a cylinder block including a planar closed deck surface, at least one cylinder opening into the closed deck surface, and an engine cooling jacket including a first portion having a closed end adjacent to the cylinder and in spaced relation to the closed deck surface, and a second portion remote from the first portion, and a cylinder head including a closed deck surface in engagement with the closed deck surface of the cylinder block and having therein at least one combustion chamber located in the cylinder head and communicating with the cylinder, and a coolant jacket located in the cylinder head in spaced relation to the closed deck surface of the cylinder head, adjacent the combustion chamber recess, and in spaced relation to the closed deck surface of the cylinder head, a pressure responsive valve communicating with the second portion of the engine coolant jacket and with the coolant jacket of the cylinder head and operative to supply coolant to the coolant jacket of the cylinder head from the second portion of the engine cooling jacket when the coolant in the second portion of the engine coolant jacket is above a predetermined pressure, and a temperature responsive valve communicating with the first portion of the engine cooling jacket and operative to discharge coolant from the engine coolant jacket when the coolant in the engine coolant jacket is above a predetermined temperature.

Other features of and advantages of the invention will become apparent to those skilled in the art upon review of the following detailed description, claims, and drawings.

THE DRAWINGS

FIG. 9 is an enlarged sectional view taken along line 9—9 of FIG. 5.

Figure 1:
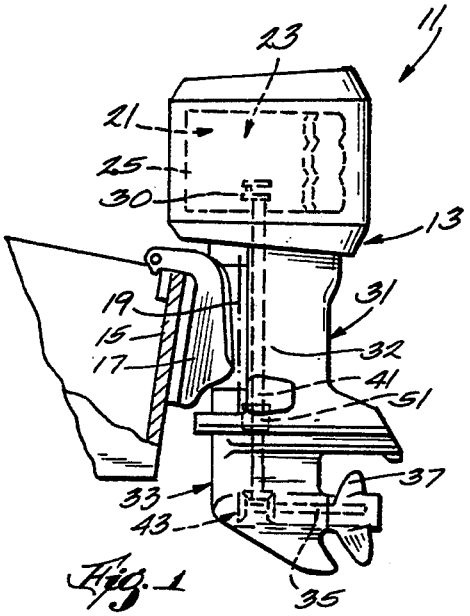
FIG. 1 is a side elevational view, partially in section, of an marine propulsion which is in the form of an outboard motor and which embodies various of the features of the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown schematically in the drawings is an outboard motor 11 including a propulsion unit 13 which is connected to a boat transom by suitable means, such as a conventional transom bracket 17 and swivel bracket 19, for affording tilting and steering movement of the propulsion unit 13 relative to the boat transom 15.

The propulsion unit 13 includes a power head 21 including an internal combustion engine 23 which can be either a two-stroke or a four-stroke engine and which comprises an engine block 25 defining a plurality of cylinders 27 and (see FIGS. 2 and 5) a coolant jacket 29 surrounding the cylinders. Included in the engine 23 is a crankshaft 30 which extends vertically.

The propulsion unit 13 also comprises a lower unit 31 including a drive shaft housing 32 which, at its upper end, is fixed to the engine block 25 and which, at its lower end, is fixed to a gear case 33 including a propeller shaft 35 carrying a propeller 37. Extending vertically in the drive shaft housing 32 is a drive shaft 41 which, at the lower end thereof, is connected through a reversing transmission 43 to the propeller shaft 35 and which, at its upper end, is drivingly connected to the engine crankshaft 30.

Located in the drive shaft housing 32 and driven by the drive shaft 41 is a suitable coolant or water pump 51 which communicates with the water in which the outboard motor is operating and which supplies coolant through a suitable conduit (not shown), to the lower portion of the coolant jacket 29 included in the engine block 25.

Figure 2:
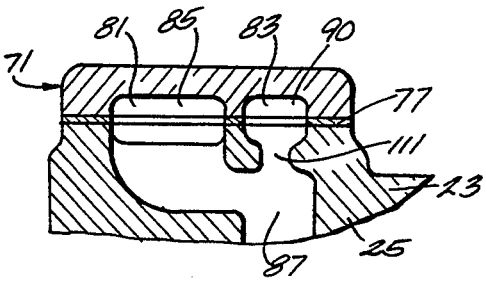
FIG. 2 is a sectional view taken across the interface between the cylinder block and the cylinder head of one embodiment of the invention.
Figure 3:
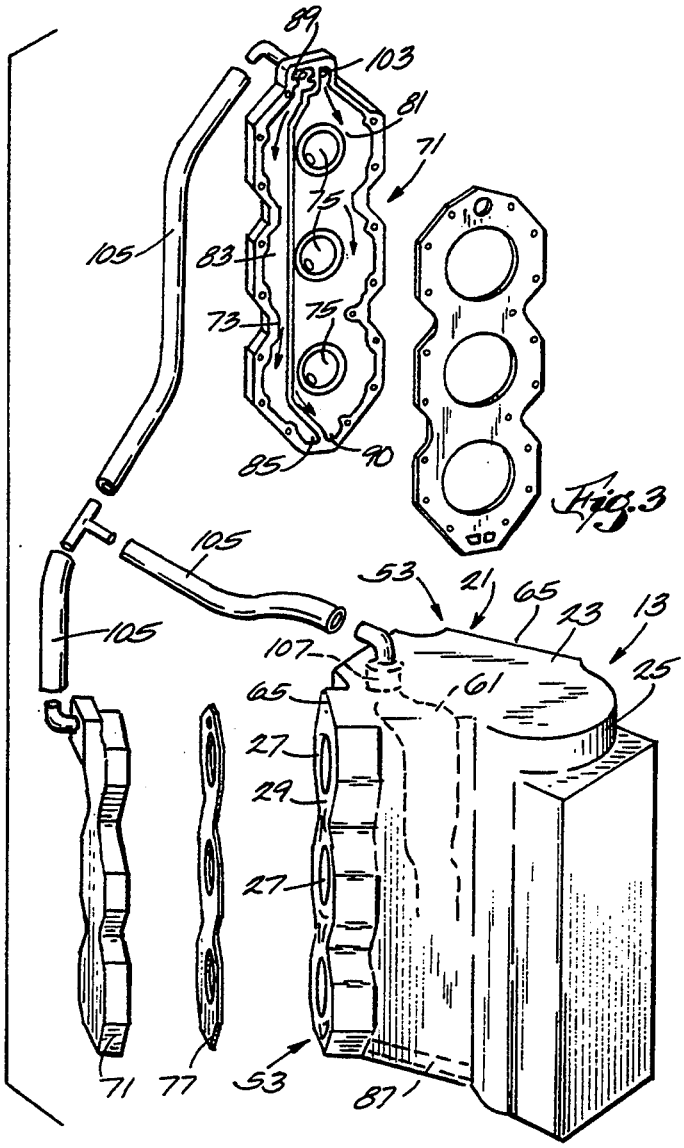
FIG. 3 is an exploded view of various of the components of the embodiment shown in FIG. 2.
Figure 5:
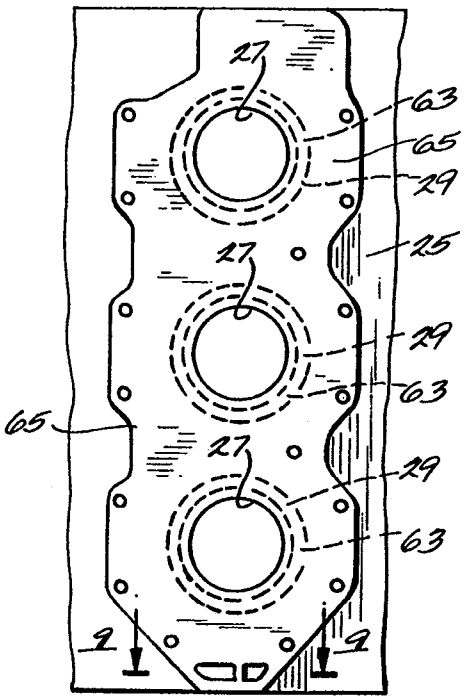
FIG. 5 is an enlarged view taken along line 5—5 of FIG. 2.

While the invention is also applicable to in-line engines, in the disclosed construction, the engine 23 is of the so called closed deck construction, V-type including (see FIG. 3) two cylinder banks 53 each including a plurality of the cylinders 27 and the coolant jacket 29 which includes a central portion 61 which is located in the valley of the V-shaped engine block 25, as well as a plurality of portions 63 which respectively encircle the engine cylinders 27 and, which as shown in FIGS. 2 and 5, have closed ends 64 spaced from a cylinder bank end surface 65 remote from the crankshaft 26.

Figure 4:
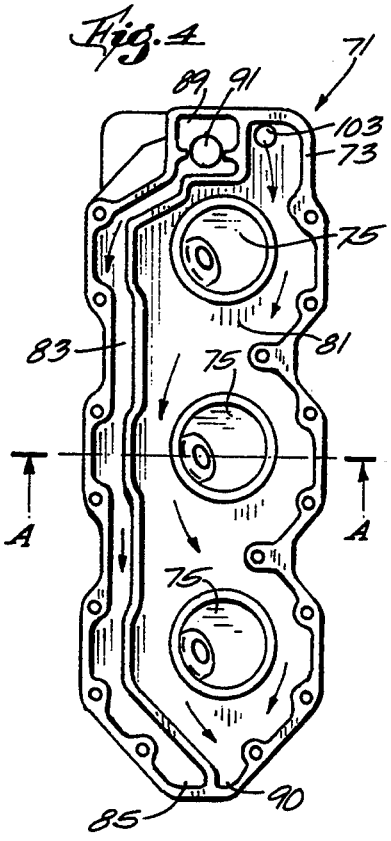
FIG. 4 is an enlarged view taken along line 4—4 of FIG. 2.

The engine 23 includes for each cylinder bank, a cylinder 71 head which includes, as shown in FIG. 4, a generally planar surface 73 which (except for the gasket 77 hereinafter referred to) mates with and engages the adjacent end surface 65 of the associated cylinder bank. The cylinder head 71 also includes therein a series of combustion chamber recesses 75 respectively communicating with the cylinders 27 in the connected cylinder bank. A suitable gasket 77 can be located between the cylinder head surface 65 and the surface 73 of the associated cylinder bank 53.

The head 71 also includes a coolant jacket 81 which extends in adjacent relation to and past all of the combustion chamber recesses 75, as well a coolant passage or second coolant jacket 83 which is located remotely from the combustion chamber recesses 75 and with the coolant jacket 81 being located, in part, between the combustion chamber recesses 75 and the coolant passage or second coolant jacket 83. In the construction disclosed in FIGS. 2 through 5, the coolant jacket 81 and coolant passage 83 are provided by recesses in the surface 73 of the cylinder head 71. As can be readily observed, the cross-sectional areas of the cooling jacket 81 and of the coolant passage 83, when viewed in a common plane such as the plane A—A in FIG. 4, are such that the size and/or volume of the coolant jacket 81 is, at a minimum, several times larger than the size and/or volume of the coolant passage 83.

The coolant passage 83 includes an outlet end 85 which is located at the lower end of the cylinder head 71 and which communicates with a dump passage 87 in the engine block 25 for returning coolant (water) to the body of water in which the outboard motor is operating. The coolant passage 83 also includes an inlet 89 which is located at the upper end of the cylinder head 71 and which communicates through temperature responsive means 91 with the engine coolant jacket 29 so as to supply coolant from the engine coolant jacket 29 to the coolant passage 83 when the temperature of the coolant in the engine coolant jacket 29 is above a predetermined temperature.

Any suitable thermostatic valve (shown schematically at 91) which opens above a pre-determined temperature can be employed. The thermostatic valve 91 is located in the cylinder head 71 and communicates through the mating surfaces 65 and 73 (and through the gasket 77) with the cooling jacket portion 67 surrounding the upper cylinder 27.

The coolant jacket 81 includes an outlet end 90 which is located at the lower end of the cylinder head 71 and which communicates with the water in which the outboard motor is operating through the previously mentioned dump passage 87. The coolant jacket 81 also includes, at the upper end of the cylinder head 71, an inlet 103 which communicates through a suitable duct or flexible line 105 with a pressure responsive valve 107 which, in turn, communicates with the central portion 61 of the engine water jacket 29 so as to supply relatively cool coolant (water) for the coolant jacket 81 in the head 71 when the pressure of the coolant in the engine coolant jacket 29 is above a pre-determined pressure. In this last regard, any suitable pressure responsive valve, shown schematically at 107, which opens in response to pressure above a pre-determined pressure in the coolant in the engine water jacket 29 can be employed. The pressure relief valve 107 is located at the top of the engine block adjacent to the central portion of the engine water jacket 29.

In conventional outboard motor construction, the pressure in the engine coolant jacket 29 increases with engine speed and, thus, the pre-determined pressure level can be associated with a speed above idle engine operation. Accordingly, coolant will not flow through the head coolant jacket 81 under idle conditions, but does flow through the coolant jacket 81 at engine speeds above idle. Furthermore, because the coolant jacket is supplied with water from the central portion 63 of the engine cooling jacket 29 (remote from the cylinders 27), the coolant arrives at the coolant jacket 81 in the head at a relatively cool condition.

Means are also provided for maintaining the coolant jacket 81 in the head 71 full of water so as to enable smooth extraction of heat and avoidance of hot spots when the engine is operating above idle speed. While other constructions can be employed, in the disclosed construction, such means comprises a restriction 111 located in the engine block 25 in the communication between the outlet end 90 and the sump passage 87. The restriction 111 causes the flow rate through the outlet 90 to be less than the possible flow rate through the inlet 103. Specifically, the cross-sectional area of the restriction 111 is less than the cross-sectional area of the inlet 103.

The head cooling arrangement employed herein serves to avoid fouling of the engine spark plugs (not shown) when the engine is operating at idle speeds and thereby prevents stalling of the engine. Elimination of such spark plug fouling has been accomplished by creating a "dry head" that allows for the temperature of the metal around the spark plugs to increase at idle, thus eliminating the fouling problems.

In operation, water from the water pump 51 is directed up through the valley of the engine block 25 and around the cylinders 27 in a known manner. At low engine speed and at low temperature, the thermostatic valve 91 is closed and there is no water at all in the head. At idle, as the temperature rises, the thermostatic valve 91 opens and water travels through the second cooling jacket 83 and is discharged through the dump passage 87. As can be readily appreciated, the main cooling jacket 81 in the head 71 is dry at this time so that there is only minimal cooling of the head 71 by the coolant (water) and thus the area around the spark plugs remains heated by combustion.

When the speed of the engine rises above idle, the pressure in the coolant increases and, in addition to flow through the thermostatic valve 91 as described above, when the engine speed reaches approximately 2000 rpm, the water is sufficiently pressurized to open the pressure relief valve 107. Downstream of the pressure relief valve 107, this water is directed into the main coolant jacket 81. As already pointed out, this flow of water is restricted by the outlet 111 at the bottom of the Block 25 so that once the main cooling jacket 81 fills, it fills entirely and has ample cooling capacity at the upper ranges of engine speed.

Figure 6:
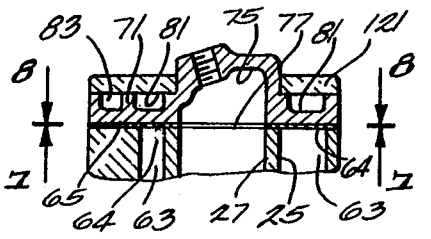
FIG. 6 is a sectional view taken across the interface between the cylinder block and the cylinder head of another embodiment of the invention.
Figure 2:
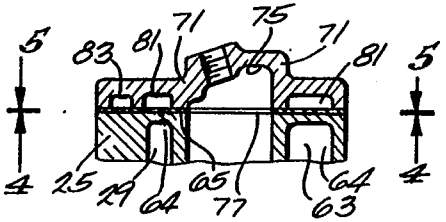
Figure 7:
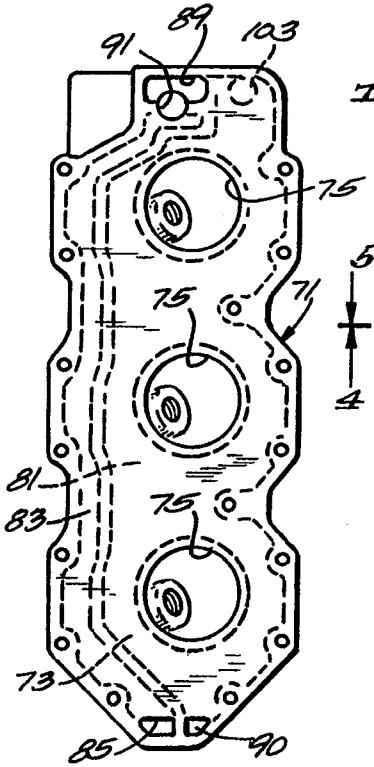
FIG. 7 is an enlarged view taken along line 7—7 of FIG. 6.
Figure 8:
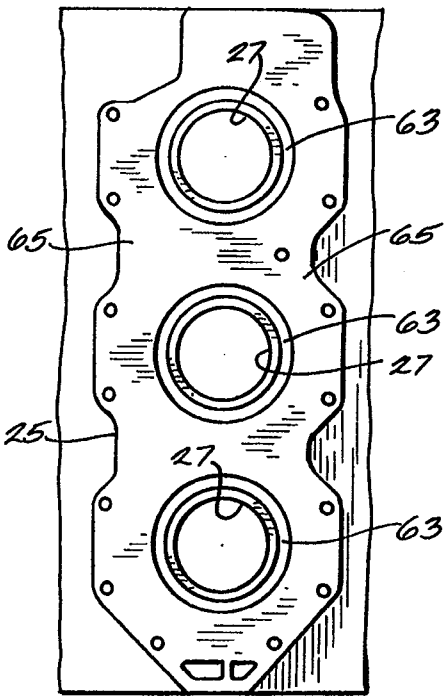
FIG. 8 is an enlarged view taken along line 8—8 of FIG. 6.

Another embodiment of a so called closed deck engine construction is shown in FIGS. 6 through 8 in which the same reference numerals, as applied to the first embodiment, are also applied to similar components in the FIG. 6 through 8 embodiment. In the FIGS. 6 through 8 embodiment, the ends 64 of the coolant jacket portions 63 which surrounds the engine cylinders 27 are open in the end face 65 of the cylinder bank as particularly shown in FIGS. 6 and 8. The head 71 also includes a surface 73 which, except for the interposed gasket 77, mates with the end surface 65 of the associated cylinder bank 53. However, as shown in FIG. 7, in general, the surface 73 has therein only the combustion chamber recesses 75.

The coolant passage 83 and the coolant jacket 81 are, unlike in the embodiment shown in FIGS. 2 through 5, on the outer side of the cylinder head 71, i.e., are not in the planar surface 73, and are closed by a suitable coolant (water) jacket cover 121. In other respects, the construction shown in FIGS. 6 through 8 is the same as the construction shown in FIGS. 2 through 5, except that the ducts 105 are connected with the coolant jackets 81 through the head coolant jacket cover 121, and not through the head 71, and except that outlets 85 and 90 pass through the cylinder head 71 from the planar surface 73 to the coolant jacket 81 and the coolant passage 83. In this regard, as shown at the bottom in FIG. 7, (and in FIG. 11) the outlet 90 is of considerably smaller size than the adjacent size of the coolant jacket 81 so as thereby to restrain the outflow from the coolant jacket 81 and cause maintenance of coolant in the coolant jacket 81.

The operation of the embodiment shown in FIGS. 6 through 8 is the same as the operation of the embodiment shown in FIGS. 2 through 5.

Figure 10:
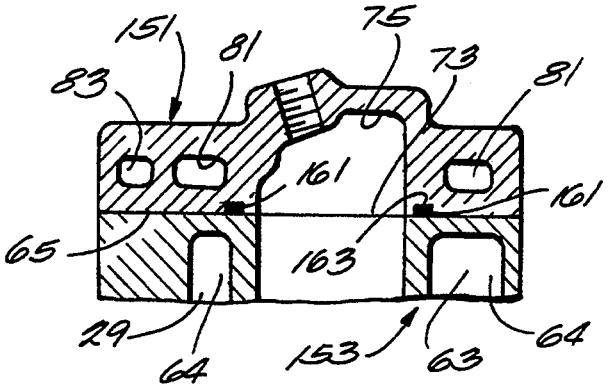
FIG. 10 is a sectional view similar to FIGS. 2 and 6 of still another embodiment of the invention.

Shown in FIG. 10 is still another embodiment of the invention which is a composite of the embodiments shown in FIGS. 2 and 6 and which employs a cylinder head 151 similar to that shown in FIG. 6 and a cylinder block 153 which, except as noted below, is generally identical to that shown in FIG. 2. Accordingly, the cylinder block 153 is of the closed deck type, i.e., only the cylinders 27 open into the surface 65.

The cylinder head 151 shown in FIG. 10 differs from the cylinder head shown in FIG. 6 in that the cylinder head 151 combines the cylinder head 71 and and cover 121 of FIG. 6 in one-piece which is fabricated from the lost foam process, but which, except as noted below, is otherwise the same as the construction shown in FIG. 6. As a consequence the cylinder head 151 is of the closed deck type, i.e., only the combustion chambers 75 opens into the surface 73.

Figure 11:
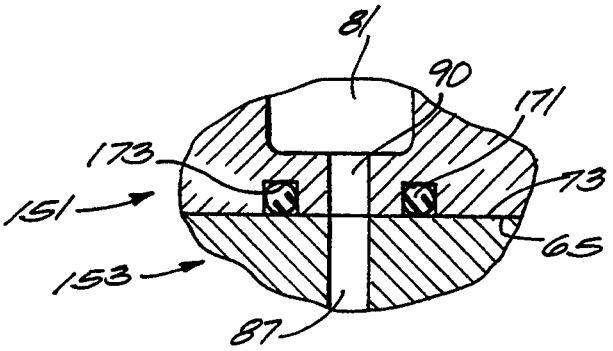
FIG. 11 is an enlarged fragmentary view of a portion of the embodiment shown in FIG. 10.

In addition, the embodiment shown in FIG. 10 differs from the embodiment shown in FIGS. 2 and 6 in that the gasket 77 is omitted, and, instead, respective O-rings 161 are located at the interface between the cylinder head 151 and cylinder block 153 and around each of the communications between the cylinders 27 and combustion chambers 75 and in respective annular grooves 163 which are provided in one of the cylinder head 151 and cylinder block 153. As shown in FIG. 11, a suitable O-ring 171 can also be employed around the communication through the interface between the cylinder head 151 and the cylinder block 153 of the coolant passage 90 and the conduit 87. The O-ring is located in a suitable annular groove 173 provided in one of the cylinder head 151 and cylinder block 153.

As a further alternative, the coolant passage 83 may be omitted in the cylinder head and the coolant passing through the temperature responsive valve can be returned to the coolant source (body of water) through a suitable conduit (not shown) which does not pass through the cylinder head.

In all of the embodiments, because the sole supply communication of the coolant jacket 81 is through the pressure responsive valve, there is thus provided means operable, when the engine is operating at low speeds, i.e., speeds insufficient to open the pressure responsive valve, for preventing flow to the cooling jacket, and thus operating with a dry coolant jacket, even though the temperature may be sufficiently high to open the temperature responsive valve.

Various of the features of the invention are set forth in the following claims.

I claim:

1. A cylinder head assembly comprising a cylinder head including a planar surface adapted for engagement with a cylinder block and having therein a combustion chamber recess, a coolant jacket located adjacent to said recess, and a coolant passage extending in said cylinder head remotely from said recess, pressure responsive valve means communicating with said coolant jacket and with a source of coolant and operative to supply coolant to said coolant jacket when said coolant is above a predetermined pressure, and temperature response valve means communicating with said coolant passage and with a supply of coolant and operative to supply coolant to said coolant passage when said coolant is above a predetermined temperature.

2. A cylinder head assembly in accordance with claim 1 including means for maintaining said cooling jacket full of coolant when said pressure responsive valve means is operative to supply coolant to said cylinder head.

3. A cylinder head assembly in accordance with claim 2 wherein said means for maintaining said coolant jacket full of coolant includes, in said coolant jacket, an inlet communicating with said pressure responsive valve means and having a cross sectional area, and an outlet having a cross sectional area less than said cross sectional area of said inlet.

4. A cylinder head assembly in accordance with claim 1 wherein said coolant jacket is located between said recess and said coolant passage.

5. A cylinder head assembly comprising a cylinder head including a planar surface adapted for engagement with a cylinder block and having therein a combustion chamber recess, a coolant jacket recess located in said planar surface, adjacent to said combustion chamber recess, and including an inlet having a cross sectional area, and an outlet having a cross sectional area less than said cross sectional area of said inlet, whereby to maintain said coolant jacket recess full of coolant upon supply of coolant to said inlet, and a coolant passage recess located in said planar surface and extending in spaced relation to said combustion chamber recess and with said coolant jacket recess located between said coolant passage recess and said combination chamber recess, a pressure responsive valve communicating with said inlet of said coolant jacket recess and with a source of coolant and operative to supply coolant to said coolant jacket recess when said coolant is above a predetermined pressure, and a temperature responsive valve communicating with said coolant passage recess and with a source of coolant and operative to supply coolant to said coolant passage recess when said coolant is above a predetermined temperature.

6. A cylinder head assembly in accordance with claim 5 including means for maintaining said cooling jacket recess full of coolant when said temperature responsive valve is operative to supply coolant to said cylinder head.

7. A cylinder head assembly in accordance with claim 6 wherein said means for maintaining said coolant jacket recess full of coolant includes, in said coolant jacket, recess, an inlet communicating with said pressure responsive means and having a cross sectional area, and an outlet having a cross sectional area less than said cross sectional area of said inlet.

8. An internal combustion engine including a cylinder block including a planar closed deck surface, at least one cylinder opening into said closed deck surface, and an engine cooling jacket including a first portion extending adjacent to said cylinder and having a closed end in spaced relation to said closed deck surface, and a second portion remote from said first portion, and a cylinder head including a planar surface in engagement with said closed deck surface of said cylinder block and having therein at least one combustion chamber recess located in said cylinder head planar surface and communicating with said cylinder, a coolant jacket recess located in said cylinder head planar surface and adjacent to said combustion chamber recess, and a coolant passage recess located in said cylinder head planar surface and extending in spaced relation to said combustion chamber recess and with said coolant jacket recess being located between said coolant passage recess and said combustion chamber recess, a pressure responsive valve communicating with said second portion of said engine coolant jacket and with said coolant jacket recess and operative to supply coolant to said coolant jacket recess from said second portion of said engine cooling jacket when said coolant in said second portion of said engine coolant jacket is above a predetermined pressure, and a temperature responsive valve communicating with said first portion of said engine cooling jacket and with said coolant passage recess and operative to supply coolant to said coolant passage recess when said coolant in said first portion of said engine coolant jacket is above a predetermined temperature.

9. An engine in accordance with claim 8 including means for maintaining said cylinder head cooling jacket recess full of coolant when said temperature responsive valve is operative to supply coolant to said cylinder head cooling jacket recess.

10. A cylinder head assembly in accordance with claim 9 wherein said means for maintaining said coolant jacket recess full of coolant includes, in said coolant jacket recess, an inlet communicating with said pressure responsive valve and having a cross sectional area, and an outlet having a cross sectional area less than said cross sectional area of said inlet.

11. A cylinder head assembly comprising a cylinder head including a surface with a cylinder block and having therein a combustion chamber recess and a coolant jacket located in said head adjacent said recess, means for preventing coolant flow to said coolant jacket when engine speed is below a predetermined speed, even if engine temperature is hot, said coolant flow preventing means comprising pressure responsive valve means communicating with a source of coolant and with said coolant jacket, means for maintaining said cooling coolant when said pressure responsive valve means is operative to supply coolant to said coolant jacket, said means for maintaining said coolant jacket full of coolant including an inlet communicating between said pressure responsive valve means and said coolant jacket and having a cross sectional area, and an outlet communicating with said coolant jacket and having a cross sectional area less than said cross sectional area of said inlet.

12. A cylinder head assembly in accordance with claim 11 wherein said coolant flow preventing means constitutes the sole source of coolant supply for said coolant jacket.

13. An internal combustion engine including a cylinder block including a planar closed deck surface, at least one cylinder opening into said closed deck surface, and an engine cooling jacket including a first portion having a closed end adjacent to said cylinder and in spaced relation to said closed deck surface, and a second portion remote from said first portion, and a cylinder head including a closed deck surface in engagement with said closed deck surface of said cylinder block and having therein at least one combustion chamber located in said cylinder head and communicating with said cylinder, and a coolant jacket located in said cylinder head in spaced relation to said closed deck surface of said cylinder head, adjacent said combustion chamber recess, and in spaced relation to said closed deck surface of said cylinder head, a pressure responsive valve communicating with said second portion of said engine coolant jacket and with said coolant jacket of said cylinder head and operative to supply coolant to said coolant jacket of said cylinder head from said second portion of said engine cooling jacket when said coolant in said second portion of said engine coolant jacket is above a predetermined pressure, and a temperature responsive valve communicating with said first portion of said engine cooling jacket and operative to discharge coolant from said engine coolant jacket when said coolant in said engine coolant jacket is above a predetermined temperature.

14. An internal combustion engine in accordance with claim 13 wherein said closed deck surface of one of said cylinder head and said cylinder block includes therein an annular groove extending around the communication between said combustion chamber and said cylinder, and further including an O-ring in said annular groove.

15. An engine in accordance with claim 13 wherein said cylinder head coolant jacket communicates with a restricted discharge conduit opening into said cylinder head closed deck surface, and wherein said cylinder block includes a coolant discharge conduit which opens into said cylinder block closed deck surface and communicates with said cylinder head discharge conduit, wherein said closed deck surface of one of said cylinder head and said cylinder block includes therein an annular groove located around the communication between said discharge conduits, and further including an O-ring in said annular groove.

* * * * *